US005107086A

United States Patent [19]

Yangas

[11] Patent Number: 5,107,086

[45] Date of Patent: Apr. 21, 1992

[54] MULTIUSE MICROWAVE COLLECTOR AND ACCELERATOR SYSTEM

[75] Inventor: Roger A Yangas, Willowbrook, Ill.

[73] Assignee: Louis P. Yangas, Orland Park, Ill.

[21] Appl. No.: 356,435

[22] Filed: May 24, 1989

Related U.S. Application Data

[63] Continuation-in-part of Ser. No. 144,520, Jan. 15, 1988, Pat. No. 4,877,933, which is a continuation-in-part of Ser. No. 19,216, Feb. 26, 1987, Pat. No. 4,771,155.

[51] Int. Cl.[5] ..... H05B 6/80

[52] U.S. Cl. ..... 219/10.55 F; 219/10.55 R; 89/8; 126/438

[58] Field of Search ..... 219/10.55 F, 10.55 R, 219/10.55 E, 10.55 M, 121.36, 121.48; 126/438, 439, 451; 102/293; 89/1.1, 8

[56] References Cited

U.S. PATENT DOCUMENTS

| | | | |
|---|---|---|---|
| 3,896,786 | 7/1975 | Clevett | 126/451 |
| 4,018,211 | 4/1977 | Barr | 126/439 |
| 4,683,362 | 7/1987 | Yangas | 219/10.55 F |
| 4,733,236 | 3/1988 | Matosian | 342/7 |
| 4,771,155 | 9/1988 | Yangas | 219/10.55 F |
| 4,912,742 | 3/1990 | Nath | 219/10.55 M |
| 4,943,325 | 7/1990 | Levy | 126/439 |

*Primary Examiner*—Philip H. Leung

*Attorney, Agent, or Firm*—Silverman, Cass & Singer, Ltd.

[57] ABSTRACT

A collector cell having at least three interconnected prongs. The prongs can be triangular shaped tabs interconnected at the base by a lead. The cell can be utilized individually as a microwave energy collector and accelerator for forming an energy field or plasma. The cells can be formed in a connected, enclosed array to form a uniform energy field. The cells can be utilized individually or in an unconnected array as an accelerator.

30 Claims, 9 Drawing Sheets

FIG. 12
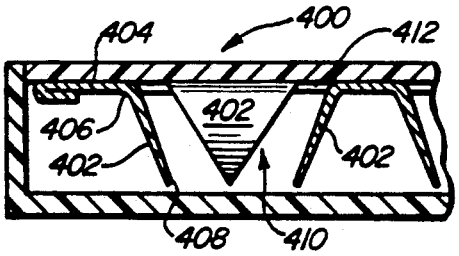
FIG. 13C
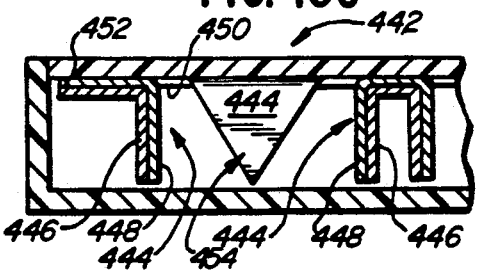
FIG. 13A
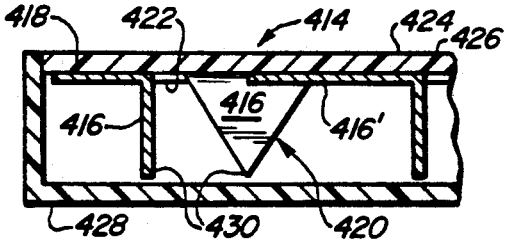
FIG. 13B
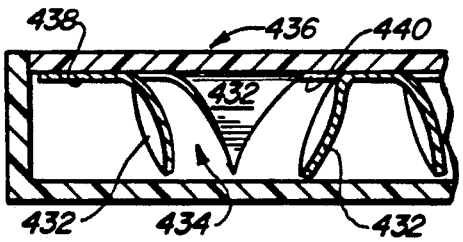
FIG. 13D
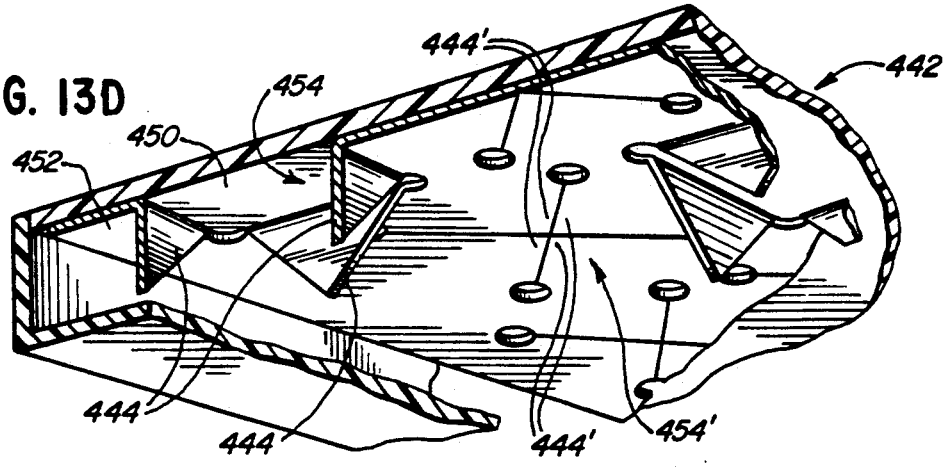
FIG. 15
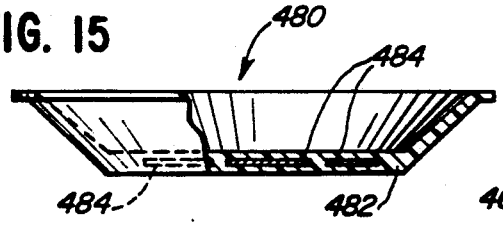
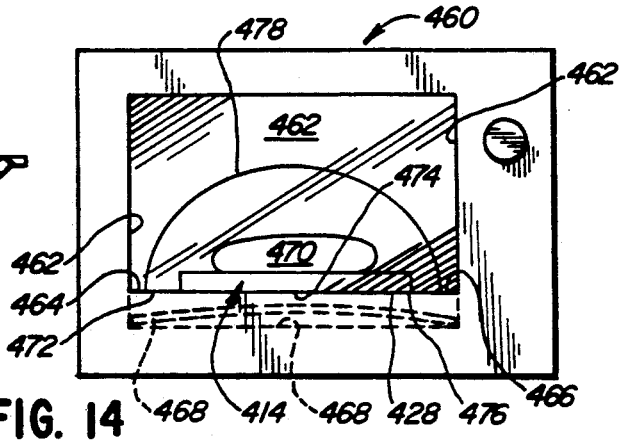
FIG. 14

FIG. 16
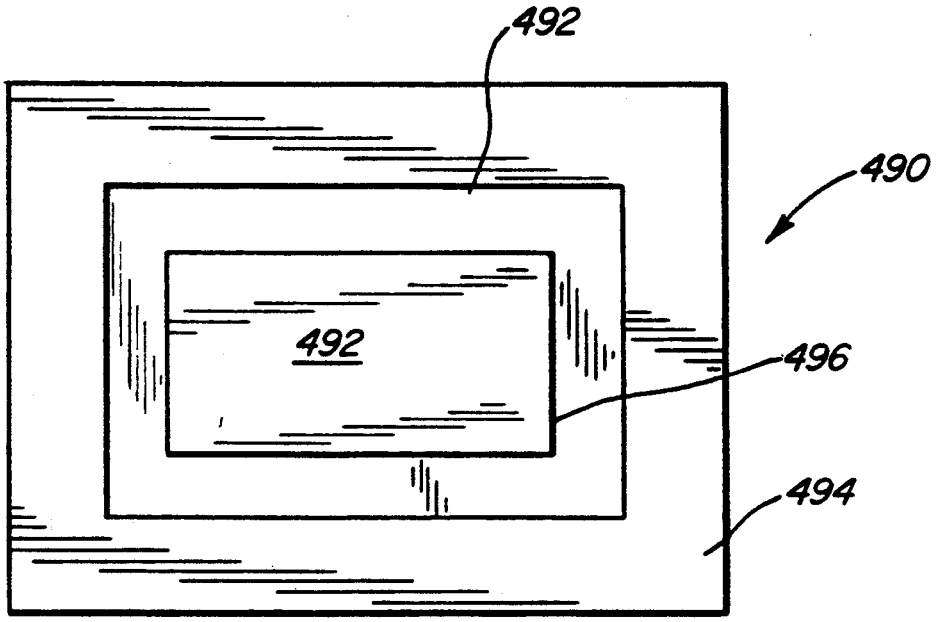
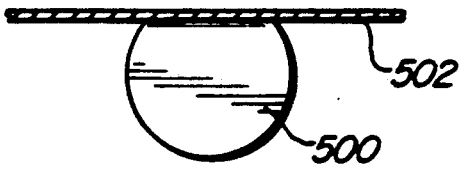
FIG. 17A
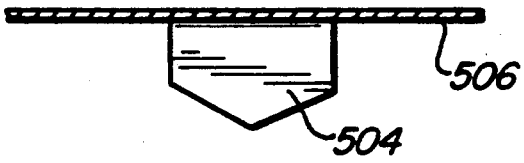
FIG. 17B

FIG. 26
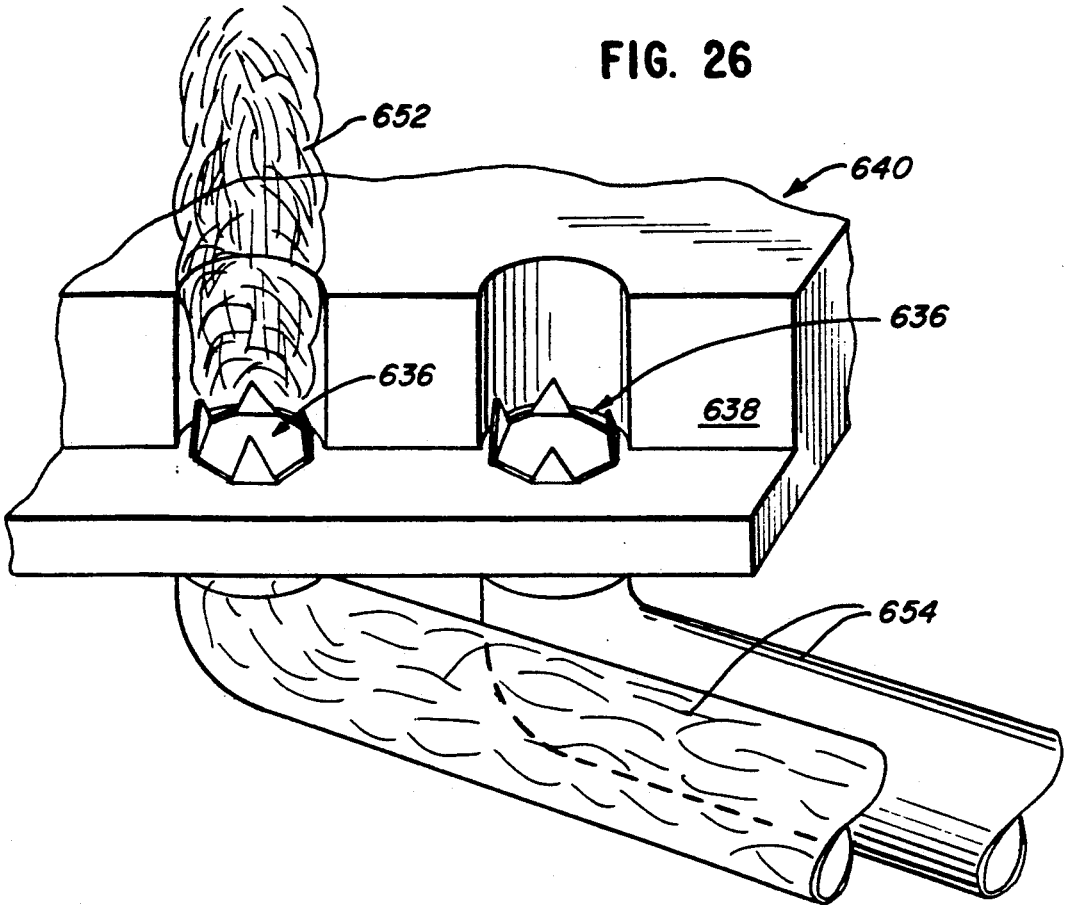
FIG. 27
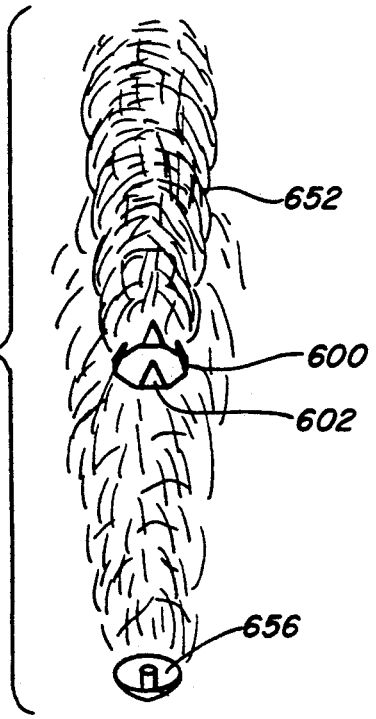
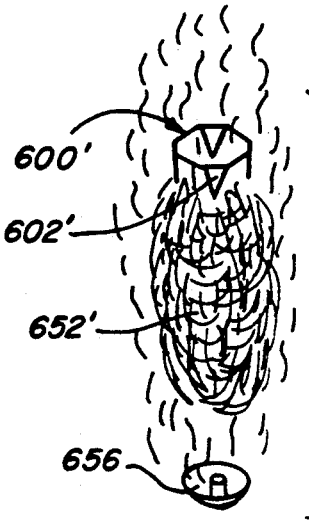
FIG. 28

FIG. 29
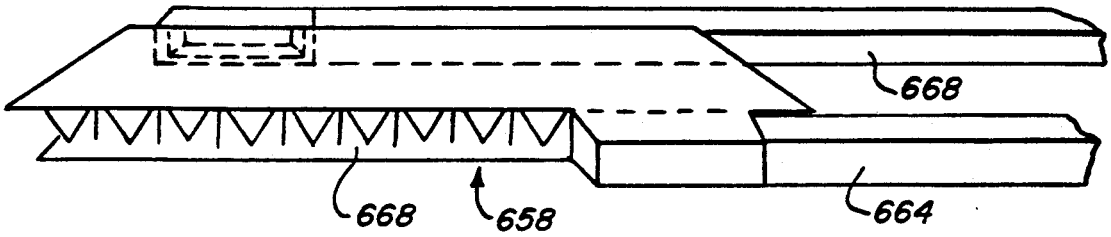
FIG. 30
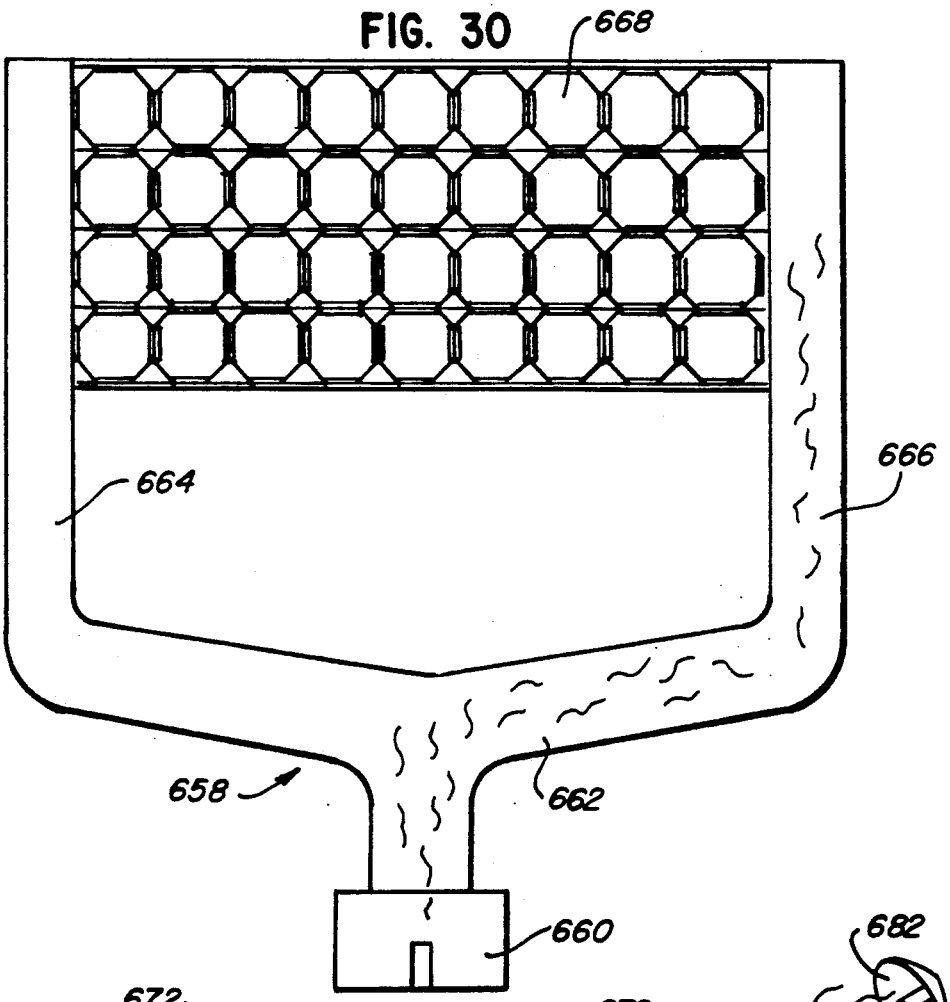
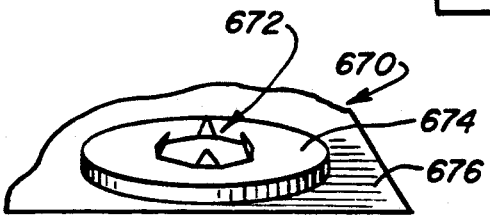
FIG. 31
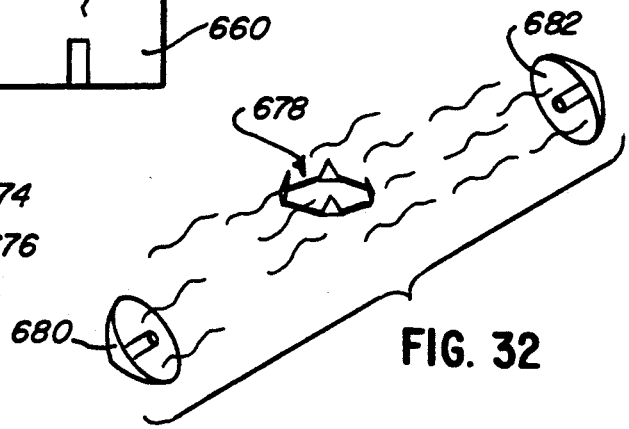
FIG. 32

MULTIUSE MICROWAVE COLLECTOR AND ACCELERATOR SYSTEM

CROSS-REFERENCE TO RELATED APPLICATIONS

This application is a continuation-in-part of prior pending application, U.S. Ser. No. 144,520, filed Jan. 15, 1988, now U.S. Pat. No. 4,877,933, which is a continuation-in-part of U.S. Ser. No. 019,216, filed Feb. 26, 1987, now U.S. Pat. No. 4,771,155, the disclosures of which are incorporated herein by reference.

BACKGROUND OF THE INVENTION

This invention relates to the collecting of microwave energy and more particularly to a method and apparatus for generating a controlled energy field therefrom including generating a radiant energy field or accelerating particles to form a plasma.

The use of radiant energy for cooking, particularly in connection with a microwave oven, has become widespread in recent years. An estimated 66% of the 88 million American households now have microwave ovens and, in the post World War II period, microwaves have been the fastest growing appliance tracked by the Association of Home Appliance Manufacturers. Microwave cooking has reached this level of popularity primarily because food products can be heated quickly and conveniently without the inconvenience of a lengthy meal preparation. The energy in a microwave oven, however, is not distributed equally throughout the cavity of the oven and this unequal distribution causes some areas in the oven to be warmer than others. As a consequence, the food product or products in those areas become hotter resulting in significant temperature differences between separate portions of the food products or within a single portion of a food product.

Many attempts have been made to equalize microwave heating of food products. For example, stirring reduces the unequal heating effects, but there are many food products that cannot easily be stirred. Rearranging, or rotating, the food product within the oven cavity also can reduce the unequal heating effects, but the food product generally must be moved often to cook even substantially uniformly, a procedure that greatly reduces the convenience aspect of microwave cooking. Automatic devices to rotate the food products have been provided, but are not totally successful and add complexity and cost to the microwave units.

First parent application Ser. No. 019,216 provides a simplified device for the uniform heating of a food product that can be utilized in connection with a conventional radiant energy source such as a microwave oven. The device also can be utilized in connection with a commercial conveyor belt system wherein the food product is placed on the trays of the device, and the trays are thereafter passed through a radiant field. This conveyor application is useful in a commercial cooking environment such as an institution or in the production of precooked food products.

Second parent application Ser. No. 144,520 provides a method and apparatus to control distribution and power within the cells of a device such as the parent application Ser. No. 019,216 for promoting the uniform heating of a food product in a radiant energy field.

Although a common specific use of microwave energy is in microwave ovens, the collected microwave energy can be utilized for many other uses, where electrical or magnetic energy is required.

SUMMARY OF THE INVENTION

The present invention provides a method and system for collecting microwave energy, which can be utilized as a source of electrical or magnetic energy. One or a plurality of cells, each including at least three prongs, are utilized to collect the microwave energy.

The cells can be provided in an interconnected array to promote uniform heating of a food product or other objects. The cells can be utilized individually or in a non-interconnected array, which also can be utilized in a warning or weapons system. The microwave energy directed to the warning or weapons system can be selected to heat personnel as a warning or to provide a high energy field which would destroy the electronic components in a targeted object.

A plasma can be formed and projected into the atmosphere or space and can be utilized to destroy radar installations or aircraft. Plasma pulses also can be utilized as an engine or propulsion means for space vehicles. The cells can be utilized as a portion of a microwave rechargeable battery.

BRIEF DESCRIPTION OF THE DRAWINGS

FIGS. 1-11B are directed to the simplified device of first parent application Ser. No. 019,216 with FIG. 1 illustrating a perspective view of the device mounted on the floor of the cavity of the radiant energy heating oven;

FIG. 2 is a perspective view of the simplified device of FIG. 1;

FIG. 3 is a side sectional view of the device of FIG. 2 taken along the line 3—3 therein;

FIG. 4 is a partial top plan view of a base illustrating several collectors each having a plurality of tabs cut from the base and angled upwardly from the base;

FIG. 5 is a partial top plan view of the base of FIG. 4 as seen before tabs are angled upwardly from the base;

FIG. 6 is a perspective view illustrating the simplified device mounted on the walls of the cavity of the radiant energy heating oven;

FIG. 7 is a top plan view illustrating the encasing structure of FIG. 3 as a segmented tray having a plurality of sections;

FIG. 8 is a schematic illustrating the device in conjunction with a commercial conveyor belt system;

FIG. 9 is a partial side sectional view of a single collector illustrating the bimetallic tabs;

FIG. 10 is a partial side sectional view illustrating the opposed collectors of an alternative embodiment;

FIG. 11B is a top plan view of the base shown in FIG. 11A illustrated with the tabs angled upwardly from the base;

FIGS. 12-17B are directed to the second parent application and FIG. 12 is a partial side sectional view of a single cell of the collector of the present invention illustrating the use of a thickness gradient for the material utilized to construct the tabs;

FIG. 13A is a partial side sectional view of a single cell of the collector illustrating a single tab in a horizontal or closed position;

FIG. 13B is a partial side sectional view of a single cell of the collector illustrating a twisted tab;

FIG. 13C is a partial side sectional view of a single cell of the collector illustrating bimetallic tabs;

FIG. 13D is a partial perspective view illustrating both open and closed collectors;

FIG. 14 is a front view of a microwave oven illustrating a dome-shaped cover positioned over an apparatus and food product therein and illustrating a variation in the oven floor shape and design;

FIG. 15 is a side sectional view of a container illustrating a plurality of metal tab portions incorporated therein;

FIG. 16 is a top plan view of a ceramic substrate collector having a spacing border;

FIG. 17A is a side plan view of a rounded collector cell tab;

FIG. 17B is a side plan view of a polygon shaped collector cell tab;

FIGS. 18-34 are directed to embodiments of the present invention;

FIG. 18 is a perspective view of one cell embodiment of the present invention;

FIG. 19 is a top view of a polarized collector interconnected array of the present invention;

FIG. 20 is a side perspective view of the array of FIG. 19;

FIG. 21 is a perspective view of a system utilizing a collector array of the present invention;

FIG. 22 is a partial side sectional view of another independent cell embodiment;

FIG. 23 is a perspective view partially in section of an unconnected array of the cells of FIG. 22;

FIG. 24 is a top planar view of the cell array of FIG. 23;

FIG. 25 is a partial perspective and sectional view of the cell array of FIG. 23;

FIG. 26 is a wave guide embodiment for feeding the array of FIG. 24;

FIG. 27 is a diagrammatic view of the plasma generation of a cell of the present invention;

FIG. 28 is a diagrammatic view of the plasma generation of a cell of the present invention oriented reverse to the orientation of FIG. 27;

FIG. 29 is a perspective view of a second wave guide embodiment for feeding a collector cell array of the present invention;

FIG. 30 is a top planar view of the embodiment of FIG. 29;

FIG. 31 is a perspective view of a further single accelerator cell embodiment of the present invention;

FIG. 32 is a further diagrammatic view of an embodiment for energizing a single accelerator cell of the present invention; and FIGS. 33 and 34 are diagrammatic views of weapon system embodiments of the present invention.

DESCRIPTION OF THE PREFERRED EMBODIMENTS

FIGS. 1-11B are illustrative of embodiments disclosed in the first parent application Ser. No. 019,216.

Figure 1:
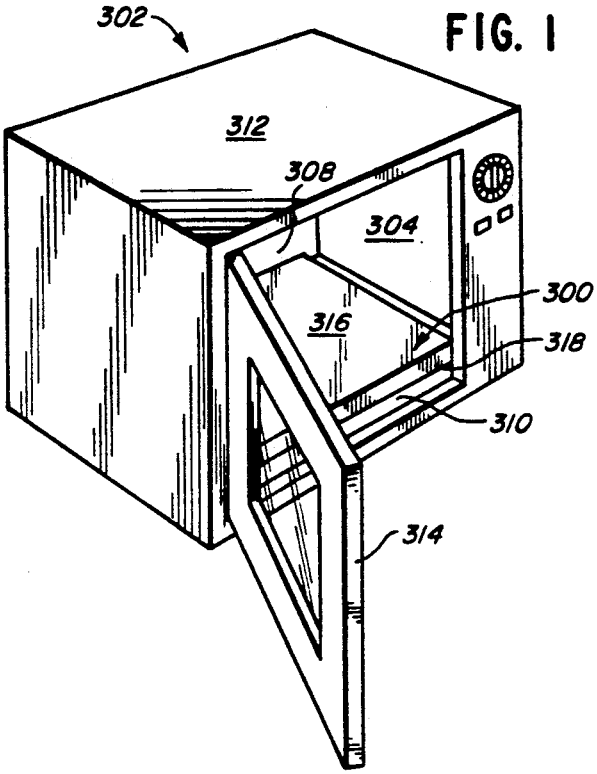

Referring to FIG. 1, one embodiment of the simplified device or apparatus is designated generally by the reference numeral 300 and is shown installed within a conventional microwave oven, designated generally by the reference numeral 302. The oven 302 has walls, for example, 304 and 308 and a floor 310. A housing 312 has an access door 314 through which to gain access to the interior of the oven 302.

As an example of the unique ability of the device 300 to uniformly heat a food product, a cake was prepared in an conventional microwave oven such as the oven 302 wherein the apparatus 300 was placed on the floor 310 of the oven 302. The cake batter was prepared from a prepackaged cake mix according to the directions on the package. A sheet of wax paper was placed on the bottom of a 12 inch square plastic cake pan before the cake batter was put in the cake pan. A sheet of plastic wrap was placed over the pan and slits were cut in the plastic wrap to allow steam to escape from the covered cake pan. After approximately 8.5 minutes on a high setting the cake had uniformly risen and uniformly cooked. Even though the cake was inadvertently tilted as it was removed from the oven, it cooled to form a cake with excellent uniformity and texture.

In another example, a 4.3 pound whole chicken was wrapped in a sheet of plastic wrap and centered on a tray formed by the device 300. The device 300 was placed on the floor 310 of the oven 302 and the chicken was heated for twenty-seven minutes at a high setting (750 watts). The chicken was uniformly cooked at that time without moving or turning of the chicken. The wrap was removed at about thirteen minutes to allow the chicken to brown. Further, the wing of the chicken, generally requiring protection from over cooking, emerged as tender and juicy as the remainder of the chicken.

The most striking example is the ability of the device 300 to promote the uniform cooking of eggs in the presence of a radiant energy heating source. In a normal microwave oven such as the oven 302, eggs will cook unevenly resulting in an unappealing inconsistency in taste, texture, and appearance. Under the influence of the energy field radiated by the device 300, however, the eggs are uniformly cooked with a remarkable balance of doneness between eggs when several eggs are prepared at the same time.

Figure 2:
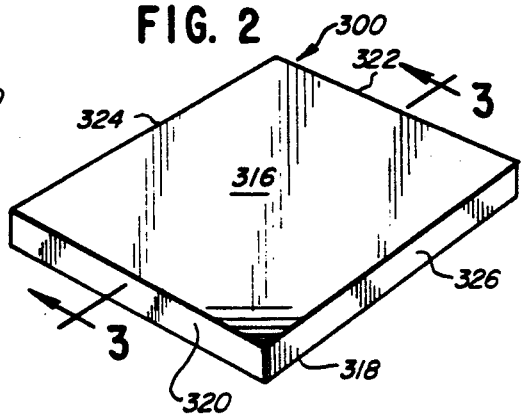

Referring to FIG. 2 the device 300 is illustrated in a perspective view wherein an upper surface 316, a lower surface 318, and walls 320, 322, 324, and 326 are more clearly seen. The device 300 is not restricted to a particular shape or dimension so long as it conforms to the limitations discussed below. However, the device 300 can be sized such that it can be placed on the floor 310 of the oven 302 when needed and conveniently removed from the oven 302 through the door 314 when not needed. Additionally, when the device 300 is configured with a relatively flat upper surface 316 and a relatively flat lower surface 318, the device 300 will sit on the floor 310 of the oven 302 such that a food container (not shown) can be placed directly on the upper surface 316.

Some glass cooking trays and containers are formed including a metallic material. It has been found that these trays and containers can interfere with the efficiency of the device 300. Generally, any plastic container designed for microwave utilization can be used in conjunction with the device 300.

Where a smaller microwave oven is used, the food product or container must not be so large that it touches the walls of the oven 302, because that will interfere with the device efficiency and can cause uneven cooking. It has been found that a distance of approximately 1 ½ inches from the walls or from the door 314 is sufficient to prevent interference with the efficiency of the device 300.

One embodiment will be discussed in greater detail with reference to FIGS. 3 and 4. A base 328 having an upper surface 330 (best seen in FIG. 3) has a plurality of collectors 334 formed therein. Each of the collectors 334 has a periphery 336 located on the base 328 and a radiant energy transparent region 338 within the periphery 336. The collectors 334 further include a plurality of tabs 340 located along the periphery 336 and extending upwardly from the base 328 over the region 338.

Figure 3:
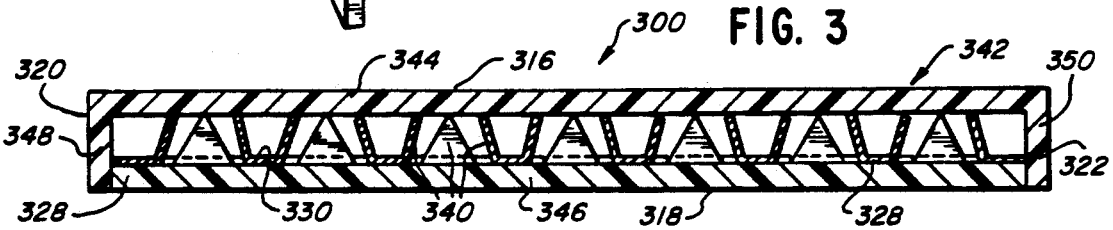
Figure 4:
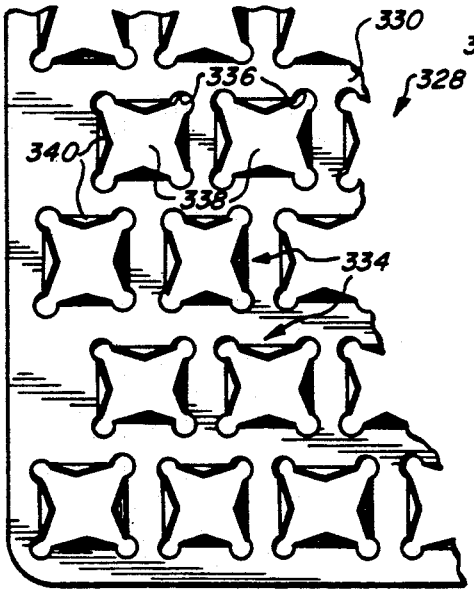

As seen in FIG. 3, the tabs 340 extend upwardly from the 328 at an angle of 80–90 degrees relative to the region 338. It is believed that the collectors 334 collect the radiant energy incident on the collectors 334 and redistribute that energy in a distinct energy field to resistively couple with the food product being heated. As the food product heats the energy field will shift to the unheated portion of the food product, thus promoting uniform heating.

The angle of the tabs 340 determine the strength of the field distributed by the collectors 334. It has been found that when the angle of the tabs 340 relative to the region 338 is less than 80 degrees the strength of the field distributed by the collectors 334 is diminished. As the angle is further decreased the strength of the field correspondingly decreases. Therefore, although the device 300 will function at other angles, a range of 80–90 degrees has been found to most efficiently promote the uniform heating of a food product.

Figure 7:
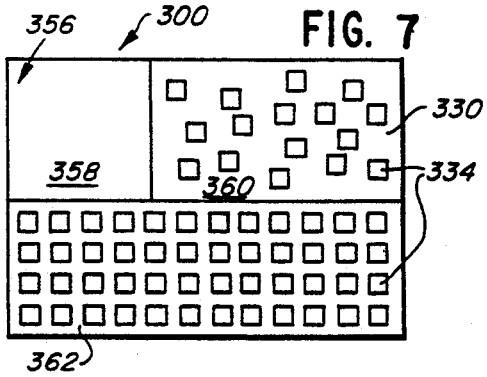

The collectors 334 are formed from a radiant energy reflective material. As will be explained, the material can be a bimetallic material wherein the angle of tabs 341 (as seen in FIG. 7) relative to the base 328 will fluctuate as the bimetallic tabs 341 first heat and then cool thus causing the field of energy distributed by the collectors 334 to correspondingly fluctuate.

Alternatively, the material can be aluminum or a similar material which will reflect the radiant energy incident on the collectors 334. Where the radiant energy reflective material is aluminum, it has been found that a thickness of 0.007 to 0.008 inches provides sufficient stability to form the tabs 340 while keeping the overall weight of the device 300 at a minimum.

An encasing structure 342 (FIG. 3) has an upper wall 344, a lower wall 346, and sidewalls 348 and 350. The encasing structure 342 is utilized to protect the collectors 334 and to prevent them from being damaged either by handling or by the food product. So as not to interfere with the efficiency of the collectors, the encasing structure 342 is formed from a radiant energy transparent material such as a high temperature thermoplastic. The encasing structure 342 is not restricted to a specific size or shape so long as it functions to encase and to protect the collectors 334 and the base 328. In fact, as will be discussed in connection with FIG. 7, the encasing structure 342 can have a tray configuration. However, it has been found that the upper surface 316 of the encasing structure 342 should be positioned such that the food product is held at least approximately ⅜ to ¾ inch away from the collectors 334 to prevent interference with the field distributed by the collectors 334.

Referring again to FIG. 4, the collectors 334 have four triangularly shaped tabs 340 located along the periphery 336. In this instance, the periphery 336 has the general shape of a square. It is also contemplated that the periphery 336 of the collectors 334 can form a circle or a hexagon. In fact, tests have shown that the most efficient shape for utilization with a small volume food product is a grouping of collectors 334 having the periphery 336 in alternating square and circular shapes.

Figure 5:
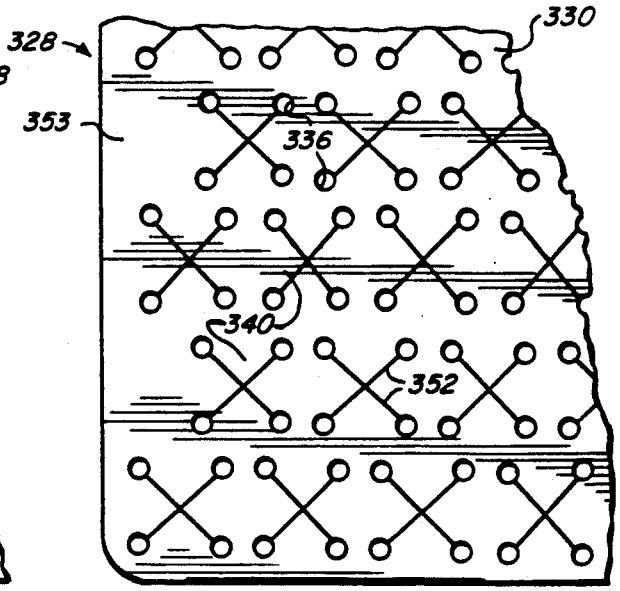
Figure 11A:
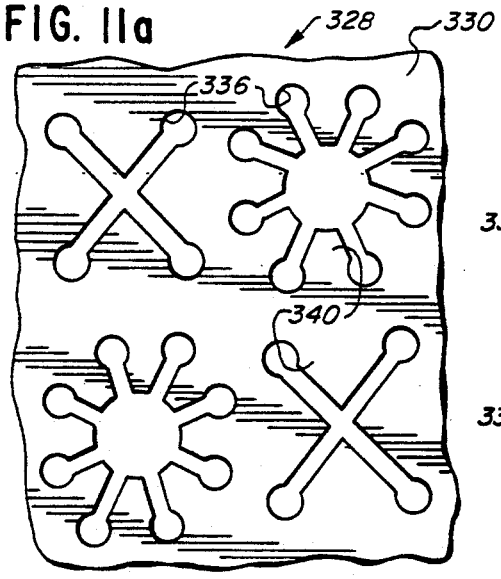
FIG. 11A is a top plan view of the base illustrating the collectors having an alternating square and circular shape with the tabs cut from the base.
Figure 11B:
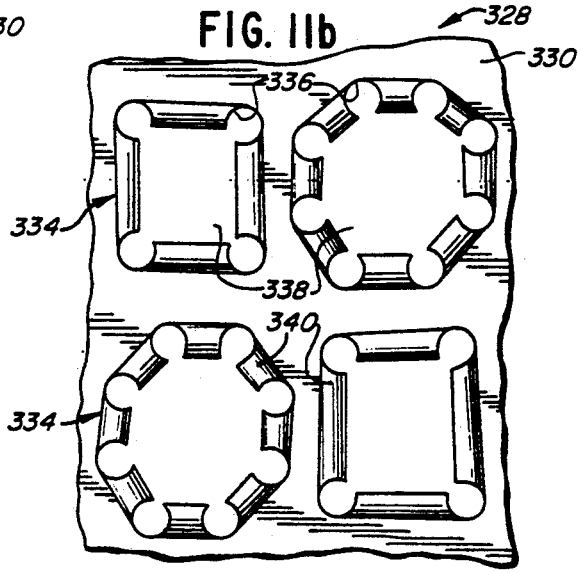
Figure 18:
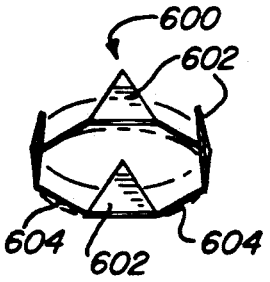

The number and shape of the tabs 340 can vary with the size of the collectors 334 and the shape of the periphery 336. For example, as seen in FIGS. 4 and 5, the collectors 334 can have a periphery 336 in the shape of a square and have four tabs 340 each of which is in the shape of a triangle or, as seen in FIGS. 11A and 11B, the collectors can have multiple tabs 340 each of which is essentially in the shape of a truncated triangle. The tabs 340, however, must be spaced apart one from another, a distance sufficient to prevent arcing in the presence of the radiant energy.

The collectors 334 can be coated with an insulating material such as silicone to further prevent arcing in the presence of the radiant energy. Other insulating materials can be substituted so long as they do not interfere with the field distributed by the collectors 334. The coating can be applied to the collectors 334 as well as to the base 328, but must at least coat the tabs 340 to effectively prevent arcing in the presence of radiant energy.

The size of the collectors 334 are related to the wave length of interest. For example, the collectors 334 with the periphery 336 having an approximate diameter of one inch can be used for a small volume food product. A larger diameter of approximately two and ⅜ inches is appropriate for a larger volume food product where a larger reflective field is necessary. Also, the collectors 334 having the periphery 336 of different diameters can be incorporated into the single device 300.

The following tests demonstrate the effect of the size of the collectors 334 on a small volume food product. The tests were performed utilizing a 12 inch by 12 inch plastic tray-shaped device 300 and a conventional consumer microwave oven set at high (750 watts). Eggs were chosen as a small volume test food. A subjective quality rating, based on a scale of one to ten, was chosen to indicate the texture, taste, and appearance of the eggs prepared using the device 300 as compared to eggs prepared using a conventional non-microwave cooking range. The approximate dimensions of the periphery 336 of the collectors 334 were as follows:

round—one and ½ inches in diameter
square—one inch on a side
large round—two and ⅜ inches in diameter

| | | |
|---|---|---|
| I. | Over 45 Round Collectors / 50 Round Collectors | A. One egg - 35 seconds<br>Cooked Medium-light<br>(very even)<br>Quality 9 |
| | | B. Two eggs - 55 seconds<br>Cooked Medium - Medium light<br>Quality 7 (balance of doneness comparatively was very good) |
| II. | Over 45 Round Collectors / Round - 28<br>Square - 27 | A. One egg - 35 seconds<br>Cooked Medium-light<br>Quality 7 |
| | | B. Two eggs - 55 seconds<br>Cooked Medium - Medium light<br>Quality 5 |
| III. | Over 45 Round Collectors / 60 Square Collectors | A. One egg - 35 seconds<br>Cooked incomplete<br>Quality N/A |
| | | B. One egg - 40 seconds |

-continued

| | | |
|---|---|---|
| | | Cooked Medium-light<br>Quality 8<br>C. Two eggs - 55 seconds<br>Cooked incomplete<br>Quality N/A |
| IV. | Over None / Round - 28<br>Square - 27 | A. One egg - 35 seconds<br>Cooked Medium light<br>Quality 9<br>B. Two eggs - 55 seconds<br>Cooked Medium - Medium light<br>Quality 7 |
| V. | Over None / 60 Square Collectors | A. One egg - 35 seconds<br>Cooked Medium-light<br>Quality 8<br>B. Two eggs - 55 seconds<br>Cooked Medium - Medium-light<br>Quality 5 (Cooked well individually no balance between eggs) |
| VI. | Over 13 Large Round Collectors / None | A. One egg - 35 seconds<br>Cooked Medium-light<br>Quality 9 (very good)<br>B. Two eggs - 55 seconds<br>Cooked Medium - Medium-light<br>Quality 7 (explosion - need more large collectors) |
| VII. | Over 13 Large Round Collectors / None | A. One egg - egg no good<br>Cooked uneven<br>Quality none<br>B. Two eggs - Same as A (insufficient collectors to carry and maintain field load) |

The above data indicates that the smaller collectors 334 will produce a good quality rating for a small volume food product such as eggs. However, where the large collectors were utilized, they were unable to create and maintain a radiant energy field to resistively couple with the eggs.

The base 328 can be a radiant energy reflective material, such as aluminum, form which the tabs 340 have been cut, formed, and angled out of the base plane. In this case, the amount of radiant energy reflected by the base 328 is directly related to the amount of material within the periphery 336 that has been removed in the process of forming the tabs 340 and to the number of collectors 334 formed on the base 328. Therefore, the collectors 334 should be spaced one from another such that the ratio of the exposed material of the base 328 compared to the area within the periphery 336 is sufficiently reduced to avoid excess interference from the radiant energy reflected by the upper surface 330 of the base 328 while not effecting the structural integrity of the base 328. For example, tests have shown that a 0.007 to 0.008 inch aluminum base 328 having the collectors 334 with the one inch diameter periphery 336 alternating in shape between square and circular should be spaced apart at a distance of ⅛ to 1/16 inch to reduce interference from the radiant energy reflected by the upper surface 330 of the base 328.

The simplified device 300 can be conveniently and inexpensively manufactured from a single sheet of radiant energy reflective material 353. Referring to FIG. 5, the outer periphery 336 is located on the sheet 353 and the collectors 334 are scored and cut. The tabs 340 are cut such that tabs 340 remain affixed to the outer periphery 336 of the base 328. The tabs 340 can be either cut or stamped from the base 328 but the edges 352 of the tabs 340 must be relatively cleanly cut so as not to interfere with the radiant energy field of the collectors 334. In the example illustrated in FIG. 5, the tabs 340 are in the shape of a triangle and, for this example, will require no further forming. The tabs 340 are bent out of plane from the base 328 to form the region 338 therebeneath. The tabs 340 are positioned at an angle of less than 90 degrees relative to the region 338 to form the collectors 334. Referring to the circular shape collectors 334 (seen in FIGS. 11A and 11B), the tabs 340 can be cut to the desired shape either with the original stamping or shaped subsequent to stamping. The collectors 334 can also alternate on a single sheet. For example, as seen in FIGS. 11A and 11B, the collectors 334 can alternate between those having a circular or a square periphery 336. Additionally, the collectors 334 can be supplied with a protective coating of an insulting material such a silicone. Finally, the base 328 and the collectors 334 are enclosed in an appropriate radiant energy transparent encasing structure.

Figure 6:
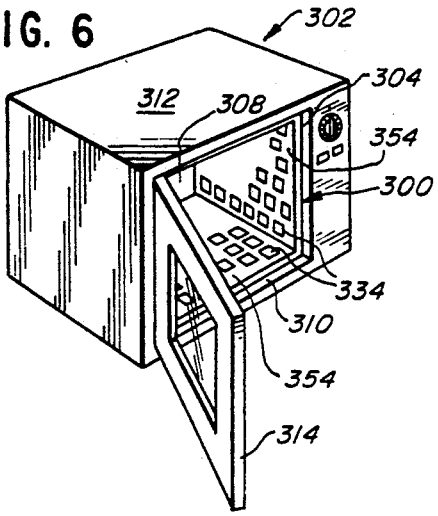

Referring to FIG. 6, the device 300 can be provided with a modified encasing structure 354 such that the device 300 can be mounted on or in one or more of the walls 304, 308 or the floor 310 of the microwave oven 302. In this case, it has been found that the collectors 334 having a larger diameter are best suited to be mounted on or in the walls because they provide a larger reflective field needed to uniformly heat a food product when it is located at a distance from the device 300. When the device 300 is mounted on or in the floor 310 of the microwave oven 302, both small and large diameter collectors 334 can be incorporated into a single device 300 to uniformly heat both small and large portions of the food product placed on the device 300.

In FIG. 7, the device 300 is shown having a tray shaped encasing structure 356. For illustrative purposes, the collectors 334 are visible through the tray shaped encasing structure 356. The structure 356 is further sectioned into compartments 358, 360 and 362. The collectors 334 are arranged on the base 330 such that each of the sectioned compartments 358, 360, and 362 vary in their ability to promote the heating of the food product. For example, the compartment 358 is shown having no collectors 334 and will, therefore, not promote the heating of the food product placed on that compartment. The compartment 360 is shown having the collectors 334 spaced relatively far apart such that the heating of the food product placed on that compartment is slightly promoted. The compartment 362 is shown having the collectors 334 tightly grouped such that the heating of the food product placed on that compartment is greatly promoted. The relative ability of each of the compartments 358, 360, and 362 could also be varied by varying the shape or size of the collectors 334 beneath that compartment such as by providing the smaller diameter collectors 334 for a smaller food product and by providing the larger diameter collectors 334 for a larger food product.

The compartments 358, 360, and 362 can be provided with identifiers, such as color, for readily identifying the relative ability of each of the compartments 358, 360, and 362 to promote the heating of the food product. In the example illustrated by FIG. 7, the compartment 358 could be identified by a cool color such as white or light blue, the compartment 360 could be identified by a warm color such as pink, and the compartment 362 could be identified by a hot color, such as red.

Figure 8:
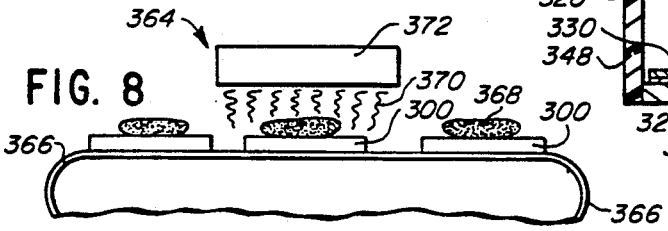

The device 300 is not restricted to use with the conventional microwave oven 302, illustrated in FIGS. 1 and 6. In FIG. 8, the device 300 is illustrated in conjunction with one example of a commercial conveyor belt system generally designated 364 having a conveyor belt 366. The device 300 with a food product 368 thereon is placed on the conveyor belt 366. As the conveyor belt 366 carries the device 300 through a radiant energy field 370 produced by a radiant energy source 372 the plurality of collectors 334 collect the radiant energy from the radiant energy field 370 that is incident on the collectors 334 and redistribute that energy in a distinct energy field to promote the heating of the food product 368. It can be seen that the device 300 having the tray shaped encasing structure 356, illustrated in FIG. 7, is particularly advantageous for use with the commercial conveyor belt system 364 illustrated in FIG. 8. An entire meal having several of the food portions 368 each requiring a separate degree of heating can be prepared with one exposure to the radiant energy field 370.

Figure 9:
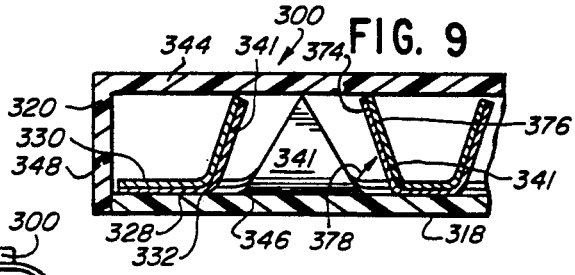

FIG. 9 illustrates one example of bimetallic tabs 341 having two bimetallic layers 374 and 376. In general, when a solid is heated, it expands. However, all substances do not expand alike. Some metals, like aluminum, expand up to twice as much as others. In the bimetallic tabs 341, two layers of different metals, are bonded together. When heated, one metal expands more than the other, causing the tabs 341 to bend. The hotter the tabs 341 become the more it will bend. When the tabs 341 cool down to the original temperature, the tabs 341 become straight again. This differential expansion is applied to the tabs 341 of the collectors 334 to effect a fluctuation of the angle between the tabs 341 and the region 338, indicated by an arrow 378. If the layer 376 is aluminum, the angle indicated by the arrow 376 will decrease as the tabs 341 are heated and then return to the original position as the tabs 341 cool. Further, the metal chosen for the layer 374 can differ according the relative thickness of the layers 374 and 376 to maintain the angle of the tabs 341 in the approximate range of 80°-90°.

Figure 10:
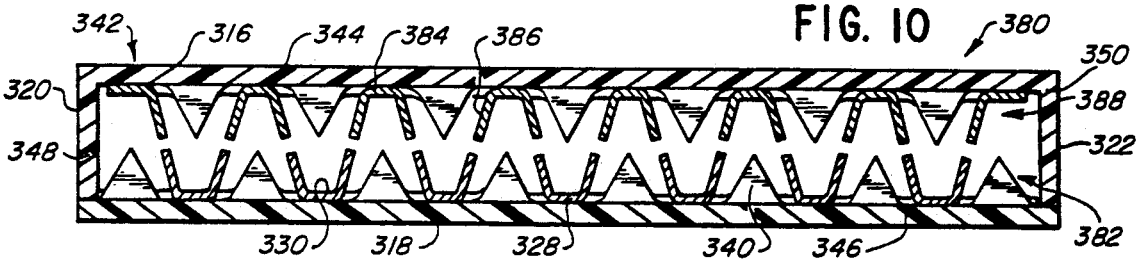

Referring to FIG. 10, a second embodiment of the simplified device or apparatus is designated generally by the reference numeral 380. In the device 380, the base 328 having the plurality of radiant energy reflective tabs 340 thereon forms a first plurality of collectors 382. A second base or plate 384 having a second plurality of radiant energy reflective tabs 386 thereon forms a second plurality of collectors 388. The plate base 384 is seen to have tabs 386 extending downwardly therefrom such that the second plurality of collectors 388 is positioned opposed to the first plurality of collectors 382 within the encasing structure 342. Tests have shown that the first plurality of collectors 382 and the second plurality of collectors 388 cooperate most efficiently when they are positioned offset one from another as illustrated in FIG. 10.

Tests have further shown that the device 380 is most efficient where the second plurality of collectors 388 are configured substantially in the shape of a square and the first plurality of collectors 382 are configured to alternate between substantially that of a square and substantially that of a circle.

The parameters and limitations discussed in reference to the device 300 of the first embodiment are equally applicable to the device 380 of the second embodiment. With reference to the device 380, it is believed that the collectors 382 and 388 cooperate to more efficiently collect the radiant energy incident on the collectors 382 and 388 and to more efficiently redistribute that energy in a distinct energy field. This distinct energy field then will resistively couple with the food product to promote the uniform heating of the food product within the reflected field.

The method and apparatus of the second parent application now will be discussed with reference to FIGS. 12-17B.

The weight or gauge of the material utilized for the construction of the collector cells has been found to vary the operation of the radiant energy collector or apparatus of the parent application. For example, a thicker gauge will cause the cells to form a stronger radiant energy field, but has a slower response and field equalization rate. A thinner gauge will result in an enhanced response rate which will equalize the fields quicker. Therefore, the performance of the radiant energy collector is enhanced when a relatively thin gauge collector material is utilized, such as an aluminum foil 0.001 to 0.003 inches. However, a thin gauge is very fragile and can be difficult to manage during the production process. One way to strengthen the material is to coat the foil with an energy transparent material to make it more durable. It has been discovered that arcing of the cell tabs is not a significant problem and the additional material is merely utilized to strengthen the tabs.

On the other hand, when a thicker gauge is utilized, for example 0.009 to 0.010 inches, the radiant energy collector is easier to manufacture, but the field of radiant energy formed by the cells can be too powerful for use with a microwave oven. One method to overcome this problem is to adjust the cell tabs to be compatible with a particular type of microwave oven. This adjustment will be discussed in detail below. Another method to overcome this problem is to utilize a thickness gradient for the cell tab material. A thickness gradient will provide a cell tab that will produce an energy field that can be utilized in a microwave oven and will also provide a construction material having the strength necessary to manufacture the radiant energy collector.

The use of a construction material having a thickness gradient is illustrated in FIG. 12. This embodiment of the radiant energy collector or improved apparatus of the parent application is designated generally by the reference numeral 400. A plurality of tabs 402 extend downwardly from a plate 404. In contrast to the orientation of the device 300 in FIG. 3, the apparatus 400 is inverted therefrom. Unexpectedly, it has been found that the radiant energy collector operates more efficiently in a microwave oven in an orientation where the tabs 402 extend downwardly rather than where the tabs 340 extend upwardly from the base 328 as illustrated in the device 300 in FIG. 3. The tabs 402 are formed from a radiant energy reflective material and are shaped such that the gauge of the tab material decreases in a gradient from a base end 406, which is affixed to the plate 404, to a free end 408. In other words, the base end 406 of the tab 402 is thicker than the free end 408. A cell 410 is formed by a radiant transparent region or opening 412 in the plate 402 formed between the tabs 402. The opening 412 generally is provided by the formation of the tabs formed or cut from the base plate 404. This construction will result in the necessary strength to manufacture the radiant energy collector but will also result in a cell that can be adjusted so that it produces an energy field compatible with a particular type of microwave oven.

Referring to FIG. 13A, another embodiment of a radiant energy collector or improved apparatus of the parent application is designated generally by the reference numeral 414. The radiant energy collector 414 again is substantially similar to the device 300 illustrated in FIG. 3, but inverted thereto. Again, a plurality of tabs 416 extend downward from a base or a plate 418. In this embodiment, the tabs 412 are formed of a uniform thickness dimension. A cell 420 is formed by a radiant energy transparent region or opening 422 in the plate 418.

Further, it has been found that the angle or position of one or more of the tabs 416' can be utilized to affect the performance of the radiant energy collector 414. When a single tab 416' of the cell is physically or manually positioned coplanar with the plate 418, i.e. in a closed position relative to the radiant energy transparent region 422, it effectively shields the portion of the food product (not shown) that is adjacent to (over) the particular closed tab 416'. It is believed that this action temporarily increases the field of energy within that cell 420. However, when a single tab is closed, the total food product will heat at substantially the same rate since other tabs 416 on the cell 420 are still open. This does not reduce the total available cooking power to the food product located over the cell 420. As additional tabs in the cell 420 are closed, the energy field in the cell 420 will become increasingly weaker until the cell reaches the point where all of the tabs 416 are in the closed position, hence the cell itself is closed (best seen in FIG. 13D).

Closing a particular cell causes it to become a power drain and a directional draw of radiant energy to that part of the oven and a drain from the microwave oven's total available heating power. Even though additional radiant energy is drawn to the area, the food product adjusts to the total oven exposure as heat increases. The radiant energy field reforms in those areas that have less resistance or where there are lower temperature areas in either the food product or in other cells of the radiant energy collector. Further, as additional cells in the radiant energy collector are closed, the radiant energy field becomes increasingly balanced. When all or most of the cells are closed, depending on the design or watts of an individual microwave oven, the food product will cease to heat. In the embodiments of FIGS. 12, 13A and 13B, the tabs are physically moved to adjust the operation of one or more cells. In the embodiment of FIG. 13C, the tabs of the collectors are designed to automatically move to adjust to the applied microwave power, which design also can be applied to all of the embodiments or selected cells therein.

By adjusting the angular position of the tabs, the available radiant energy within an individual microwave oven can be controlled. In effect, selective manipulation of the tabs can be utilized as a control mechanism to balance or direct the microwave energy to desired areas of the food product. The food product located adjacent a closed cell is shielded and will heat at a reduced rate compared to food product that is located over open cells or to food product that is not located over collector cells.

In FIG. 13A, the collector 414 is seen to have an upper exterior surface 424 on a radiant energy transparent wall 426 and a lower exterior surface 428. The wall 416 forms a portion of the radiant energy transparent encasing of the collector 414. The tabs 416 extend from the plate 418 such that a free end 430 is at an angle of 90 degrees or less relative to the plate 418. The tabs 416 are in an open position and the single tab 416' is in the closed position. In this case, the total food product will heat at the same rate since the other tabs 416 on the cell 420 are still open. However, if all of the tabs 416 are placed in the closed position (best seen in FIG. 13D) then a food product that is placed adjacent the upper exterior surface 424, above the closed cell 420, will heat slower than food product that is located over open cells.

One or more cell tabs 432 can be twisted to control the radiant energy field within a cell 434 in a collector 436 as illustrated in FIG. 13B. The twisted tabs 432 extend from a plate 438 and, with an open or energy transparent area 440, form the cell 434. The twisted tabs 432 allow radiant energy to escape from the cell 434 into the collector 436 and be transmitted to the cells, which decreases the radiant energy field created by an individual cell. The food product that is positioned adjacent cells 434 having one or more twisted tabs 432 will, therefore, cook at a decreased rate compared to the food product that is positioned adjacent to a cell having no twisted tabs.

The manipulation of individual cells within the radiant energy collector can be utilized to adjust a particular apparatus to a particular type of microwave oven. For example, the cells can be adjusted to be compatible with a particular oven by closing selected cells or by closing a single tab on several individual cells. Closing all of the tabs of a single cell will inhibit that cell from forming a radiant energy field and will shield the food product over that cell. Therefore, the heating power of the radiant energy collector is decreased to a level that is appropriate for a particular type of microwave oven.

Referring to FIG. 13C, a radiant energy collector 442 is illustrated having a plurality of tabs 444, each formed from two bimetallic layers 446 and 448. Again, an opening or energy transparent region 450, formed in a plate 452 from which the tabs 444 are formed, form with the tabs 444 an individual cell 454. In general, these layers function in the same manner as the bimetallic layers 374 and 376, illustrated in FIG. 7. When the collector 442 and hence the tabs 444 are heated, one layer expands more than the other, causing the tabs 444 to bend, and when the tabs cool down to the original temperature, they become substantially straight again. Since the tabs 444 return to substantially the same angle relative to the plate 452 each time the tabs 444 cool, they can be referred to as memory metal tabs. Careful selection of the metal utilized in the bimetallic layers 446 and 448 will produce cells 454 that automatically adjust the energy directional field as the food product heats. For example, choosing metals with coefficients of expansion that force the tab 444 to bend to the closed position (see cell 454' in FIG. 13D) when the food product is uniformly heated will provide a visual indication that the food product is done. In this case, the radiant energy collector 442 will still function as a food warmer and will keep the food product in a uniformly heated state.

Referring to FIG. 14, a conventional microwave oven is designated generally by the reference numeral 460. The conventional microwave oven 460 is constructed with radiant energy reflective interior surfaces, generally metal, such as walls 462 and a floor 464. It has been found that a radiant energy collector is affected by the distance between the cells of the collector and the radiant energy reflective surfaces. For example, improved radiant energy collector performance has been found to occur when the cells are positioned away from the walls 462 of the microwave oven 460 at least ¾ inch. In other words, the performance of the radiant energy collector is improved when none of the cells are located in the area ¾ inch or more from any of the vertical walls 462 of the microwave oven 460.

Additionally, when a radiant energy collector, for example the collector 414, is located on the floor 464 of the microwave oven 460, the optimal distance between the plate 418, located adjacent the upper wall 426, and the lower surface 428 of the radiant energy collector 414 (best seen in FIG. 13A) is approximately 1 ½ inches. For example, if the tabs 416 were to extend perpendicular to the plate 418 a distance of approximately ¾ inch, the lower surface 428 of the radiant energy collector 414 would be approximately ¾ inch from the free end 430 of the tab 416.

A false floor 466 of microwave transparent material can be utilized to position the wall 426 at a desired distance from a concealed real floor 468 of microwave reflective material. It has been found that by varying the distance between the plate 418 and the microwave reflective floor, in this case the real floor 468, the efficiency of the radiant energy collector 414 can be varied. The heating power of the energy field is most efficient when the cells 420 are positioned at the optimal distance from the radiant energy reflective floor 468 of the microwave oven 460, and this efficiency falls off when the cells 420 are positioned either closer to or farther from the real floor 468. Thus, the floor shape and design can be configured to be compatible with the heating requirements of a specific microwave oven.

Additionally, a food product 470 can be made to heat at different rates by controlling the distance between the plate 418 and the real floor 468. Where a real floor 468' is positioned farther away from the false floor 466, as for example at an area 472, the food product 470 will heat at a slower rate than when the food product 470 is located within the optimal efficiency range. Similarly, a central area 474 that is positioned closer to the false floor 466 will cause the food product 470 to heat at a slower rate than would be the case if the food product 470 were located within the optimal efficiency range. If an area 476 is at an optimal distance, then the area 476 can function to heat the body of the adjacent food product 470 and the areas 472 and 474 can be utilized to keep the adjacent body of food product 470 warm. Therefore, the real floor 468' can be configured to provide different rates or degrees of heating within the single microwave oven 460. As discussed in connection with the tray-shaped apparatus illustrated in FIG. 7, the various heating areas can be color coded to provide a visual indication of the relative heating ability of the area.

A dome or cover member 478 preferably is utilized to cover the food product 470 and the collector 414. The dome 478 is formed from a radiant energy transparent material and is not restricted to a classical dome shape. Rather, the dome is configured so as to be large enough to comfortably cover the food product 472 within the microwave oven 460 and can be large enough to cover both the food product 470 and the collector 414. The dome 478 preferably includes one or more vent openings to allow steam to escape from the dome as in a conventional roasting cover. Although, the dome 478 is not essential to the performance of the improved collectors of the parent application, it has been found that for the most uniform collector heating performance, all of the food product or products 470 in the microwave oven 460 should be covered under a single dome or cover 478. The food product 470 has been found to be heated most uniformly when covered with the dome 478. However, even without the dome 478, the collectors 414 will heat the food product 470 more uniformly than in a conventional microwave oven.

Referring to FIG. 15, a food product container is designated generally by the reference numeral 480. The container 480 is illustrated as a pie plate for example purposes, but is not intended to be restricted to a specific size or shape and can also be in the shape of a tray or a bowl. The container 480 has at least a bottom wall 482 and is shown having a plurality of blocking tab portions 484 interior to the wall 482. However, the blocking tab portions 484 also can be located on or outside of the wall 482. In any case, the tab portion or portions 484, which can be of any shape, must be positioned between the cells (not shown) and the food product (not shown). The tab portion or portions 484 are formed from a radiant energy reflective material and function to shield the food product from the energy field that is formed by the cells. The tab portions 484 are aligned to be over the central open area, such as area 450 in FIG. 13D, such as by designing the container 480 to be in register with the collector, such as the collector 442 in FIG. 13D. It has been found that the areas of food product that are shielded by the tab portions in the container will heat at a faster rate than the unshielded areas. Some food products require increased heat in specific areas of the food product, for example the center of a pie which will generally cook at a slower rate than the edges of the pie. The parent application is particularly useful in that the tab portions 484 can be aligned in those areas where increased heat is desired. It is believed that the tab portions 484 partially block the underlying cells and increase the field of energy applied to the shielded areas of the food product thus heating those areas at a faster rate than the unprotected areas of food product.

Although felt to be undesirable, it has been found that ceramics and certain plastic materials can be utilized to form one or more of the walls of the collectors. The cell plate then is mounted onto the ceramic or plastic wall, which should be of a consistent dimension and material on the order of ⅛ to ¼ inches thick. The ceramic wall appears to elevate and maintain a higher cooking temperature, which allows decreased cooking times and more efficient operating collectors. The plastic materials can include oxides or magnesium and can include metal substrates.

Referring to FIG. 16, a top plan view of a collector 490 is illustrated which includes a central area 492 having a ceramic substrate, to which the cell plate and/or cells are mounted (not illustrated). The collector 490 preferably includes a perimeter spacing portion 494, such as formed from microwave transparent high temperature plastic material. The perimeter portion 494 is ¾ to 1 ¼ inches wide to provide the desired spacing from the walls of the microwave oven. The collector 490 will operate without the perimeter 494, but operates more efficiently with the perimeter 494 or other spacing from the walls of the microwave unit. The microwaves appear to be activated by the ceramic substrate, which provides the increased cooking temperature.

The central ceramic substrate area 492 further can be enhanced by forming a thin ferrite like layer, such as tin oxide, thereover. The tin oxide, such as provided on ceramic cooking dishes (for example, the Covered Browning Skillet Model MW-A-10, sold by Corning Glass Works of Corning, N.Y.), appears to further enhance and concentrate the microwave energy to further elevate the cooking temperatures of the collector 490. A collector formed like the collector 480, with the same size cells would have at least twice the number of cells to achieve the same type of operation as the collector 490 with the tin oxide coating 496. As illustrated, the coating or layer 496 does not need to be coextensive with the central ceramic portion 492, but can be effective in a smaller central portion.

It has also been determined that the length, width and profile of the tabs affects the performance of the radiant energy collector or of a particular cell. If the tabs are too large, they will block the even distribution of radiant energy fields formed by the cells. The diameter of the cell and the length of the tabs are equally critical. It has been found that short tabs (for example, ¼ inch) as compared to longer tabs (for example ½ inch) will reduce the field strength of a 1 ⅛ inch diameter cell. Thus, the cells can be adjusted for a specific situation by adjusting the diameter of the cell and the length of the tabs.

The shape of the cells affect the amount of radiant energy reflected from or contained within the cell as well as the strength of the radiant energy field formed by an individual cell. As illustrated in FIG. 17A, it has been found that a generally rounded tab 500 formed from a plate 502 appears to present a very efficient profile in the majority of situations. Another very efficient profile is formed from a polygon shaped tab 504, illustrated in FIG. 17B. The tabs 504 are formed from a plate 506 forming the energy transparent opening, not illustrated. One particularly efficient and easily manufactured collector, has been formed by cutting three of the tabs 504 from each one of a plurality of closely spaced hexagonal shaped cells from the plate 506. The adjacent cells share the tabs 504 to form six tabs for each cell. The plate 506 then is mounted, such as by adhesive to one side of a ceramic substrate and the tin oxide layer is provided on the opposite side of the substrate. However, other tab shapes can be utilized to provide a radiant energy collector that is particularly suited to an individual type of microwave oven or to a radiant energy application other than a microwave oven.

Additionally, the number of cells within a particular radiant energy collector can be adjusted to tailor a radiant energy field to a particular model of microwave oven. In this case, variations in cell size and shape may not be necessary. For example, the optimal number of cells for a 650 watt microwave oven appears to be about 110 cells having a 1 ⅛ inch diameter without a ceramic substrate or tin oxide coating. The number of cells can be decreased to half or less that number with both the ceramic substrate and the tin oxide coating. Ideally, these cells will be located on the floor of the oven so that they are positioned beneath the food product. However, depending on the height of the oven, the walls also can be utilized to provide an optimal number of cells.

The method and apparatus of the present invention now will be discussed with reference to FIGS. 18–34.

A collector cell 600 includes a plurality of prongs or tabs 602. Although three prongs or tabs connected by a hexagon are effective, the preferred embodiment includes four separated tabs 602 connected together by an octagon shaped connecting base lead or wire 604. The optimal distance between opposing tabs 602 has been found to be on the order of one and one-eighth inches. The tabs 602 are triangular and preferably have a height of about nine-sixteenths to five-eighths inches and a width of about one-half inch. The cell 600 can be formed of a suitable metallic material for a particular use, as specified hereinafter. The prongs shaped as tabs 602 appear to provide an optimum operation for the cells 600. The prongs, however, can be of other shapes, such as wires or pins as long as the spacing therebetween is on the order of at least one-quarter inches. The pointed triangular shaped tabs 602 appear to concentrate and disperse the energy field better than the wire or tine shaped prongs.

Figure 19:
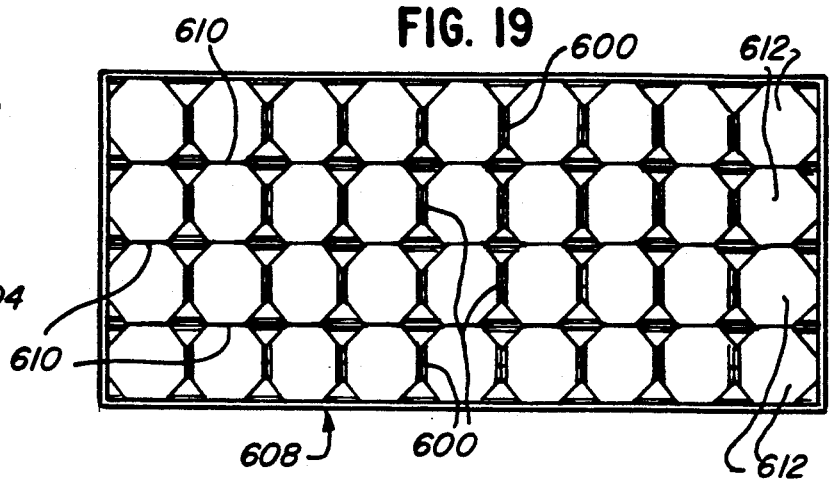
Figure 20:
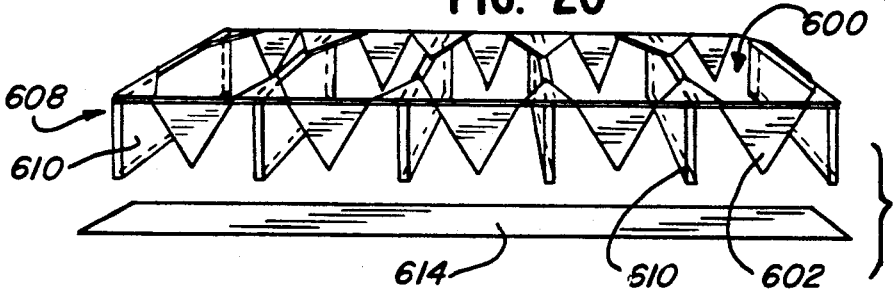

The cell 600 forms a unitary self-supporting structure, which can be utilized as a single cell, described hereinafter, or can be formed into an interconnected cell array 608, as illustrated in FIGS. 19 and 20. The array 608 includes a plurality of the cells 600. The array 608 further can include a plurality of cell separating walls 610, separating the cells 600 into a plurality of columns 612. The separated columns 612 serve to make the resulting energy field developed by the array 608 even, especially when the microwaves, such as from a conventional microwave oven, are not uniform. The array 608 acts substantially the same as a polarizer. The array 608 includes a bottom metallic plate 614, which is spaced about one and one-half inches from the base or lead 604 of the cells 600, such as by a plastic material, not illustrated. The array 608 can be utilized with low levels of microwave energy for cooking purposes or with higher energy levels for other purposes as will be described hereinafter. In a microwave oven use, the cells 608 can be made from metallic material such as aluminum, brass or copper.

The width of the cells 600 in the array 608, being about one and one-eighth inches, appears to correlate with a quarter wavelength of the microwave energy. These dimensions appear to produce an optimum result. For commercial purposes, three or four tabs 602, spaced as described above are the most convenient utilization in the cells 600. A larger number of tabs 602 can work effectively, as long as the spacing between the cells is on the order of one-quarter inch. This configuration, with up to seven tabs, appears to uniquely collect the microwave energy directed thereto for the various utilizations described herein. The interconnection of the cells 600 in the array 608 produces a substantially even confined energy field.

Figure 21:
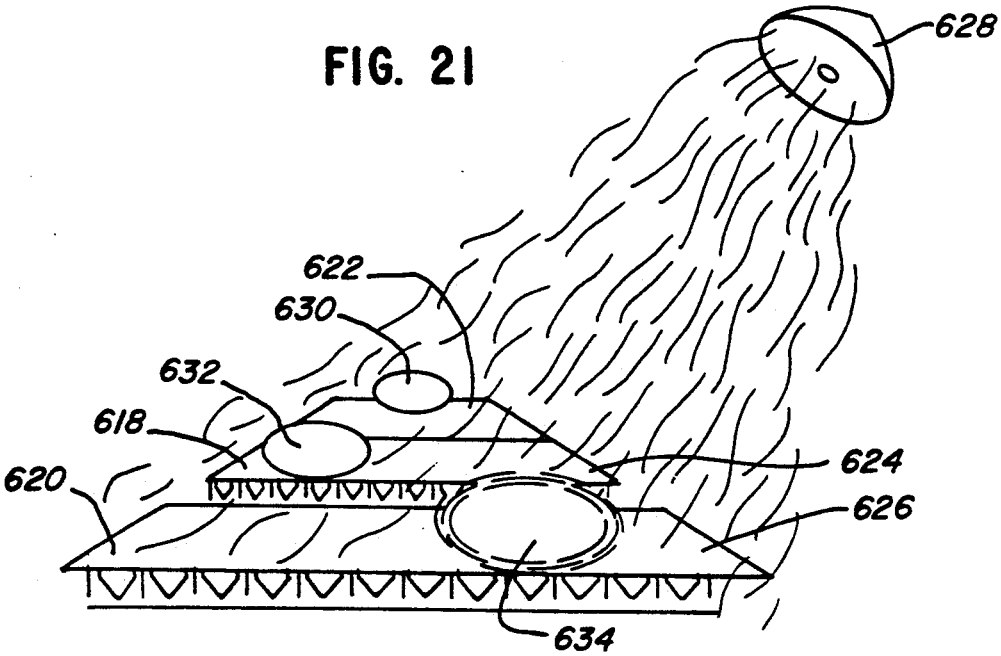

A plurality of arrays 616, 618 and 620 are diagrammatically illustrated in FIG. 21. The arrays 616, 618 and 620 can have top surfaces 622, 624 and 626, which will be a nonmetallic material. Each of the arrays 616, 618 and 620 can be substantially identical to the array 608, without the dividing walls 610. The arrays 616, 618 and 620 can be fed from a microwave energy source 628, which can be focused to direct the microwave energy at any one of the arrays 616, 618 or 620. Each of the arrays 616, 618 and 620 have an object 630, 632 and 634 thereon or adjacent thereto. The microwave energy source 628 can be focused for example on the array 620. The array 620 will collect the microwave energy, which then will be focused or transferred to the object 634, which becomes the dominant field. If the object 634 is a food product, a low level of microwave energy can be focused thereon to heat or cook the object 634, as described with respect to the parent applications Ser. No. 144,520 and Ser. No. 019,216.

If, however, the array 620 is intended for a security device, such as a threshold to a secured area, the microwave energy source 628 can impart an energy level of microwaves, on the order of 5 kilowatts to make an object, such as unwanted personnel, hot enough to be uncomfortable, or if on the order of 100 kilowatts to destroy part, such as a foot or all of the person, on or adjacent the array 620. In a like manner, the high energy field generated by the array 620, would disable or destroy any semiconductor electronic equipment in the object 634. This would effectively disable a vehicle or any other type of electronic controlled equipment. The arrays 616, 618 and 620 also could be utilized for other types of heating such as to melt snow or ice accumulated thereon. The arrays 616, 618 and 620 then become very localized, controlled heating or weapon systems.

Figure 22:
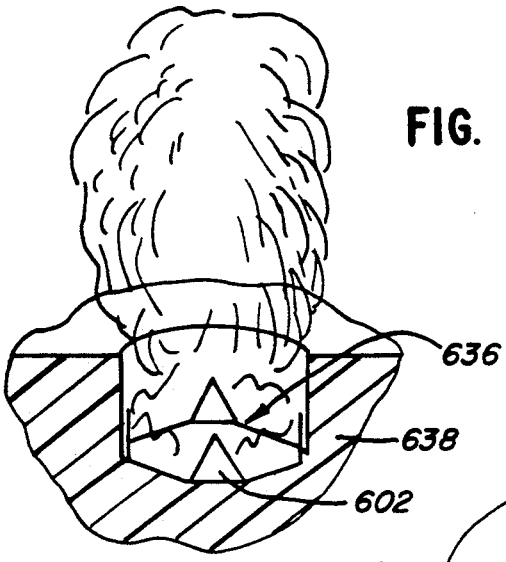
Figure 23:
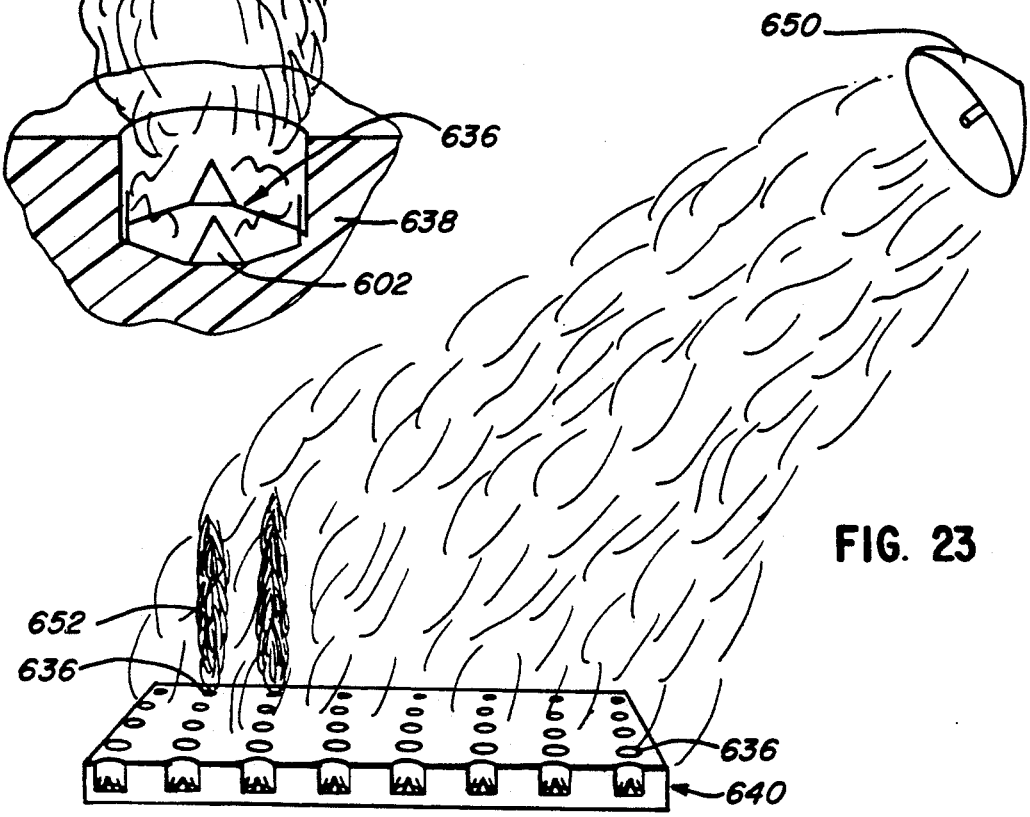
Figure 24:
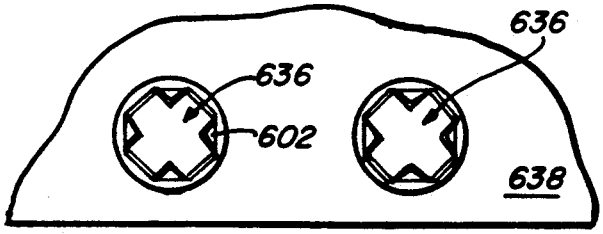
Figure 25:
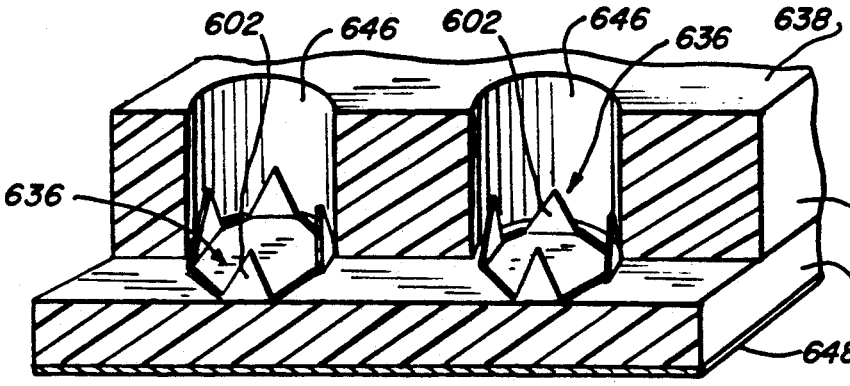

Referring to FIGS. 22–25, a plurality of cells 636 are mounted into a solid body 638 forming an unconnected cell array 640. The cells 636 can be essentially the same configuration as the cells 600. The cells 636 are not, however, interconnected. The body 638 will be formed by a ceramic, glass or other high temperature material. The body 638 can be a single piece, as illustrated in FIG. 22, or can be a pair of pieces 642 and 644 with the top piece 642 having a plurality of wells or cavities 646, formed or bored therein, into which the cells 600 are mounted, as illustrated in FIG. 25.

Again, the body 638 preferably includes a bottom metallic plate 648 spaced about five-eighths of an inch away to retain the field in conjunction with the cells 636. Again, the array can have a microwave energy source 650 focused thereon, and the cells 636 will generate individual columns of energy or plasma 652, depending upon the amount of microwave power focused thereon. A single cell 600, such as illustrated, can be utilized, however, at least 10 kilowatts of microwave energy should be focused thereon to produce a plasma field 652 from the cell 600.

The individual unconnected cells 636 appear to collect the microwave energy and accelerate particles from the cells 636 to form the plasma 652. The free end parts of the tabs 602 of the cells 636 will disintegrate as the electrons are stripped from the tabs 602. It would appear that the tabs 602 of the cell 636 operate only when interconnected by the leads 604 to collect the microwave energy and accelerate the energy field into the plasma 652. Typically, the directed microwave energy will be pulsed to form individual plasma bodies, such that the cells are not themselves destroyed at too rapid a rate. The tabs 602, for use as an accelerator, should be formed of a high density metallic material, such as tungsten.

The array 640 also can be fed from a remote microwave energy source (not illustrated) by a plurality of wave guides 654, to generate the plasma 652, as illustrated in FIG. 26. The array 640 can be fed very selectively, with the cells 600 spaced as desired. The selective feeding of the array 640 allows a very precise locating of the plasma 652. The wave guides 654 could be radially spaced around the microwave energy source which can be rotated to feed the desired wave guide 654.

The orientation of the cell 600 determines the orientation of the energy field or plasma 652 as illustrated in FIGS. 27 and 28. The cell 600 has its tabs 602 oriented away from a microwave energy source 656. The plasma 652 generated is directed away from the microwave energy source 656 in the direction of the tabs 602. A second cell 600' is oriented in the opposite direction with tabs 602' pointed back at the microwave energy source 656. The plasma 652' is then directed back at the source 656, which can be utilized to advantage as will be discussed with respect to FIG. 34.

A second remotely fed collector array 658 is best illustrated with respect to FIGS. 29 and 30. A microwave energy source 660 is coupled through a wave guide 662. The wave guide 662 includes a pair of guide tubes 664 and 666 which feed the microwave energy into an interconnected and enclosed cell array 668. The array 668 can be substantially the same as the arrays 608 or 616. The guide tubes 664 and 666 direct the microwave energy laterally into the cell array 668.

A single collector cell unit 670 is illustrated in FIG. 31. The cell unit 670 includes a collector 672, which can be substantially the same as the cell 600. The cell 672 is mounted in or on a support member 674, which can be formed of high temperature non-metallic material. The support member 674 supports the cell 672 spaced nine-sixteenths to five-eighths inches from a metallic base plate 676. The cell unit 670 enhances the formation of the energy field or plasma by encompassing the microwave energy in the cell 672.

A collector cell 678, without a base plate, is illustrated in FIG. 32. In this case, if a single microwave energy source 680 is utilized, the collector cell 670 will not be as efficient as the collector cell 670. Therefore, for the optimal operation, either a very focused microwave energy source 680 must be utilized, or a second one or plurality of microwave energy sources 682 can also be utilized to feed the collector cell 678. The two microwave energy sources 680 and 682 preferably will feed the collector cell 678 from substantially different angles to enhance the energy field formation.

Figure 33:
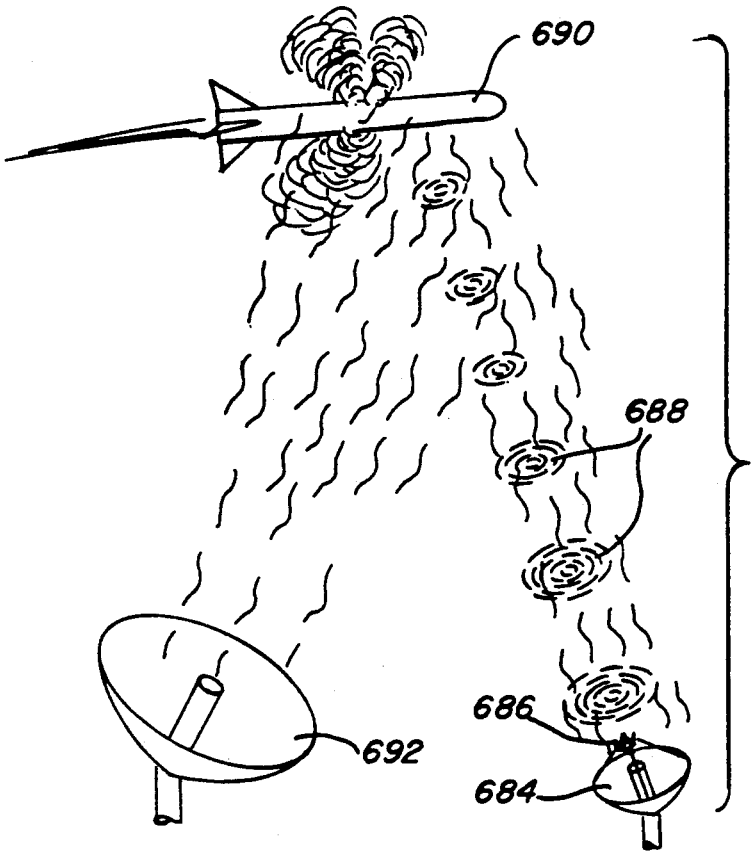

The collector cell of the invention can readily be utilized in a weapons system 682 as illustrated in FIG. 33. A microwave energy source 684 can be utilized with a collector cell 686 to form discrete energy fields or plasma bodies 688. The plasma bodies or energy fields 688 can be accelerated, substantially at the speed of light by utilizing the known scissoring effect of a second microwave energy source (not illustrated). The energy field 688 can just be sustained by the microwave energy source 684. A target 690, such as a rocket, can be neutralized by disabling or destroying the electronic components thereof. The energy fields 688 are enhanced into a larger energy field by a supplementary microwave energy source 692, which can feed large magnitude pulses to the target 690, such as millions of watts, to energize the energy fields or plasma 688 at the target area.

Figure 34:
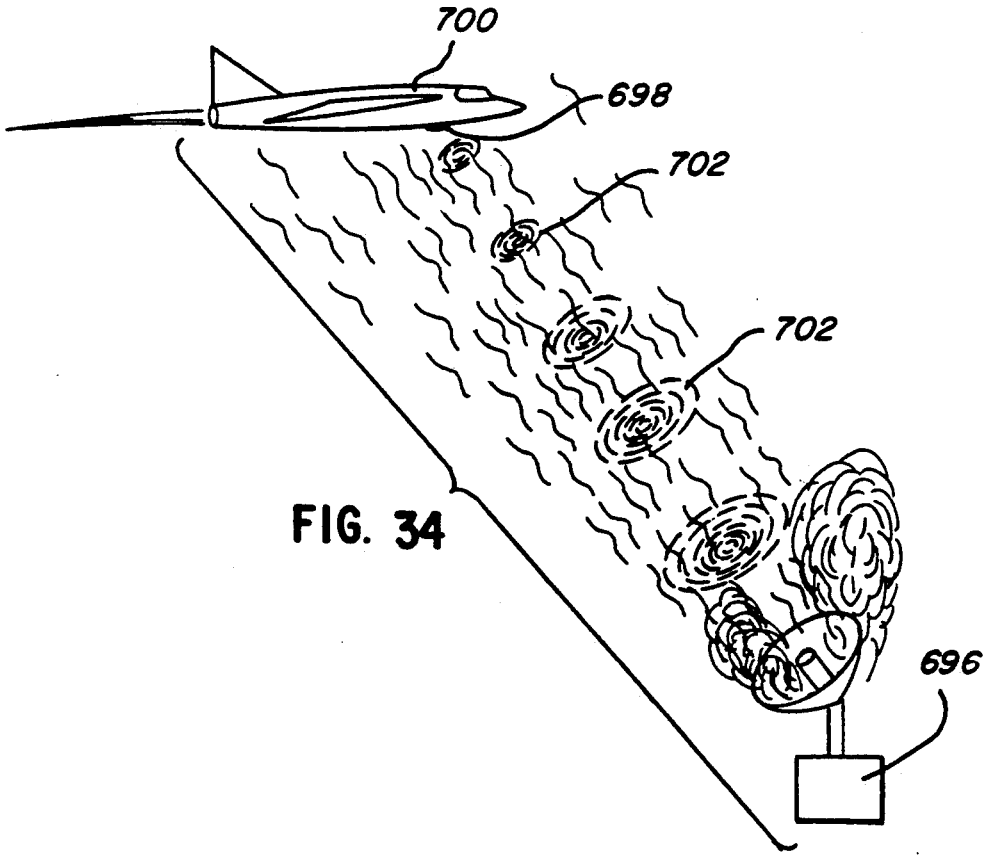

In a similar fashion, a weapons system 694 can be utilized to destroy an enemy microwave energy source as illustrated in FIG. 34. A collector cell 698 and microwave energy source (not illustrated) can be mounted on a mobile attack unit 700, such as an airplane. The collector cell 698 and microwave energy source can generate energy fields or plasma bodies 702, which are focused on the microwave energy source 696 and will feed on the microwave energy generated by the microwave energy source 696 to disable the microwave energy source 696.

In summary, the enclosed and interconnected cell array 608 can be utilized as a microwave heating source for use in a microwave oven as described in the parent application. The enclosed arrays 608 and 658 also can be utilized as warning or weapon systems by the application of higher levels of excitation energy. In any case, an object on or adjacent the arrays 608 and 658 can be warmed, heated or substantially destroyed. The interconnected array 608 also can be utilized as a portion of a battery, such as in a nickel hydrogen battery (not illustrated) with microwave energy applied to the battery to charge the battery through the array 608.

The single cells 600 or 636, etc., are not interconnected and are not confined so that they can act as an accelerator to form the plasma 652. The single cells 600 or 636 generate the plasma 652 upon being energized by about 1500 watts of microwave energy. Below 1500 watts, the individual cells 600 generate an energy field related to the energizing energy. To form higher energy plasmas, the cells 600 must be formed of high temperature, high mass metallic material.

Since the cells 600 accelerate the collected energy, it would appear possible to produce fusion by utilizing the proper tab materials that will sustain a fusion reaction such as uranium, plutonium, palladium and titanium. The acceleration of electrons being stripped from the outer orbit of the nuclei with an increase in temperature will result in a collision of these nuclei; fusion. Tests demonstrate formation of a plasma and high temperatures using common metal substances for cell construction. Internal conversion therefore may be attained by using high mass materials for the cell construction. The fusion could occur in accordance with the Muon Theory, since the electrons clearly appear to be stripped from the tabs in the accelerated energy field to form the observed plasma 652. The cells 600 appear to act as an energy coil, somewhat like a cyclotron or linear accelerator.

The energy field collected by the cell 600 or an array thereof can be utilized wherever an electromagnetic field can be utilized. The cells 600 should be capable of being utilized for propulsion, like an ion engine. The acceleration produced by the cells 600 is highly unexpected, since the plasma 652 is generated with about 1500 watts of energy or more. Known accelerator systems are expected to require on the order of megawatt radio-frequency power.

The cells 600 appear to ionize atoms or molecules of the tabs 602 by collecting the microwave energy or electromagnetic radiation. The plasma 652 will be sustained by the microwave energy energizing the plasma.

The theory of the operation of the cells 600 or the cell arrays is not understood, although various theories would appear to be possible explanations. Microwaves are electromagnetic radiation—energy resulting from the acceleration of electric charge and the associated electric fields and magnetic fields. The energy can be regarded as waves propagated through space (requiring no supporting medium) involving oscillating electric and magnetic fields at right angles to each other and to the direction of propagation. The microwave collector 600 utilizes this radiation in a series or array of the cells 608 to form a collector grid. This grid-like device 608, when exposed to a microwave beam, or microwaves through a wave guide, assembles these microwaves into magnetic spheres within the cells of the grid. The magnetic fields in the grid are maintained until a physical object, such as object 634 in FIG. 21, passes within a close proximity. At that intersection, the object 634 becomes the dominant magnetic field, and the associated electric fields and magnetic fields are transferred from the charged cells of the grid. The projected field, requiring no support medium, is maintained and equalized in and around the object by the collector. The effect this field has upon the object will be determined by the energy level of the beam and the size and consistency of the object. Any device or concept can now be achieved that requires electric and/or magnetic energy. Configurations of the microwave collector can be used as actual components in electrical devices.

In weapons systems, as above described, the microwave collector can be used in various situations because the power beam can be regulated by increasing or decreasing energy levels or by pulsating high energy for micro seconds. In this way, it can be used for crowd control perimeter defense of buildings, satellites, etc. The collector or collector arrays can be installed in streets, walkways, tunnels, tops of buildings, space station super structures. Once in place, the collector can be charged through wave guides or by a portable or stationary beam. For increased effect, both the wave guide and the microwave beam can be applied simultaneously. Electronic and mechanical devices are very susceptible to microwaves. Electronic ignition, alternators, any printed circuits or computers, etc., could be disrupted or destroyed within the influences of the collector system. The effect of the collector on any object can be as subtle as a static shock or as strong as a bolt of lightning.

With magnetic levitation, all forms of transportation would be effected. Power and propulsion systems could be all coordinated with levitation to work with one tri-functional energy unit. A high magnetic field created by a collector, which could be part of the outer skin of a craft would act as a shield keeping the hot ionizing gases at a distance. Charging the collector cells could be achieved from inside the spacecraft or directing a beam from the ground. For magnetic energy storage, a cell configuration could be used in the nickel hydrogen battery with exciting results. Presently, this battery requires hours to recharge from an electrical source or relies on expensive, cumbersome solar cells.

When the microwave collector is a component of the battery plates, these restrictions for recharging no longer apply. When the collector battery is exposed to microwaves, the transformation from microwaves into electricity occurs within the collector cells which are also the storage cells of the battery. Instantaneously every dual purpose cell is receiving a maximum charge and within minutes is fully recharged. Conversion of microwaves to electromagnetic fields and storage of electrical energy can be attained by a dual purpose collector. The dual purpose collector would collect microwaves and would also serve as the battery's cell plates which convert electromagnetic fields into stored energy simultaneously. When the battery is exposed to microwaves, the transportation, collection, conversion and storage of the energy becomes a one-step charging system all in minutes. Used in this manner, the microwave collector functions similarly to superconductive material but without the physical shortcomings which normally make the use of such material counterproductive.

The use of superconductive coils with a collector installed, would accept a projected charge of energy at just under the speed of light. This type of immediate power could make the star wars defense initiative cost feasible.

The collector array is highly beneficial in warming because of its unique ability of uniform energy control. The collector array can be engineered to within 8–10 degrees of temperature variance. Examples: warming blood, tissue samples, organs and limbs.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. An apparatus for collecting microwave energy and generating an energy field or plasma therefrom, said apparatus comprising:

a collector cell, said cell including at least three metallic prongs, each having a base opposite a free point, spaced a substantially equidistance from one another and connected together by a lead at the respective bases, said lead being contained substantially in a plane with the free points of said prongs oriented substantially perpendicular to said plane, said collector cell collecting microwave energy directed thereto and generating an energy field directed away from said collector cell in the direction of said points.

2. The apparatus as defined in claim 1 wherein said prongs are triangular tabs having triangular free points.

3. The apparatus as defined in claim 2 including means for mounting said collector cell with said base plane spaced from a metallic plate and said tab points oriented away from said plate to enhance the generation of said energy field.

4. The apparatus as defined in claim 2 including a plurality of said collector cells spaced from one another in an array.

5. The apparatus as defined in claim 4 including means for mounting said collector cell with said base plane spaced from a metallic plate and said tab points oriented away from said plate to enhance the generation of said energy field.

6. The apparatus as defined in claim 4 including an array body with each of said collector cells mounted in said body.

7. The apparatus as defined in claim 6 including each of said collector cells mounted in the wells formed in said body.

8. The apparatus as defined in claim 4 including means for feeding said collector cells individually by directing microwave energy selectively thereto.

9. The apparatus as defined in claim 8 wherein said microwave energy feeding means include microwave energy wave guides coupled to said cells.

10. The apparatus as defined in claim 4 wherein said array of collector cells are interconnected to one another.

11. The apparatus as defined in claim 10 wherein said interconnected cells are enclosed by a non-metallic material.

12. The apparatus as defined in claim 10 wherein said interconnected cells are polarized by a plurality of separators, one between adjacent rows of cells in said array.

13. The apparatus as defined in claim 2 wherein said cell includes at least four metallic triangular tabs connected together by said lead to form a octagon-shaped cell.

14. The apparatus as defined in claim 1 including means for feeding said collector cells individually by directing microwave energy selectively thereto.

15. The apparatus as defined in claim 14 wherein said microwave energy feeding means include microwave energy wave guides coupled to said cells.

16. A weapons system, comprising:

a collector cell, said cell including at least three metallic prongs, each having a base opposite a free point, spaced a substantially equidistance from one another and connected together by a lead at the respective bases, said lead being contained substantially in a plane with the free points of said prongs oriented substantially perpendicular to said plane, said collector cell collecting microwave energy directed thereto and generating a plasma field directed away from said collector cell in the direction of said points, said plasma field being of sufficient energy to enable a desired target upon which said plasma field is directed to be disabled or destroyed; and means for generating microwave energy and coupling said microwave energy to said collector cell.

17. The system as defined in claim 16 wherein said prongs are triangular tabs having triangular free points.

18. The system as defined in claim 17 including means for mounting said collector cell with said base plane spaced from a metallic plate and said tab points oriented away from said plate to enhance the generation of said energy field.

19. The system as defined in claim 17 including a plurality of said collector cells spaced from one another in an array.

20. The system as defined in claim 19 including means for mounting said collector cell with said base plane spaced from a metallic plate and said tab points oriented away from said plate to enhance the generation of said energy field.

21. The system as defined in claim 19 including an array body with each of said collector cells mounted in said body.

22. The system as defined in claim 21 including each of said collector cells mounted in the wells formed in said body.

23. The system as defined in claim 19 including means for feeding said collector cells individually by directing microwave energy selectively thereto.

24. The system as defined in claim 23 wherein said microwave energy feeding means include microwave energy wave guides coupled to said cells.

25. The system as defined in claim 19 wherein said array of collector cells are interconnected to one another.

26. The system as defined in claim 25 wherein said interconnected cells are enclosed by a non-metallic material.

27. The system as defined in claim 25 wherein said interconnected cells are polarized by a plurality of separators, one between adjacent rows of cells in said array.

28. The system as defined in claim 17 wherein said cell includes at least four metallic triangular tabs connected together by said lead to form a octagon-shaped cell.

29. The system as defined in claim 16 including means for feeding said collector cells individually by directing microwave energy selectively thereto.

30. The system as defined in claim 29 wherein said microwave energy feeding means include microwave energy wave guides coupled to said cells.

* * * * *

UNITED STATES PATENT AND TRADEMARK OFFICE

CERTIFICATE OF CORRECTION

PATENT NO. : 5,107,086

DATED : April 21, 1992

INVENTOR(S) : Roger A. Yangas

It is certified that error appears in the above-identified patent and that said Letters Patent is hereby corrected as shown below:

Column 5, line 13, the word "base" is omitted before the numeral "328";

Column 8, line 19, the word "insulting" should be --insulating--;

Column 10, line 63, "the plate 402" should be --the plate 404--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*